US009708725B2

(12) United States Patent
Lindgren et al.

(10) Patent No.: US 9,708,725 B2
(45) Date of Patent: Jul. 18, 2017

(54) METHOD FOR MAINTENANCE OF USED PERMANENT CATHODE PLATES

(71) Applicant: OUTOTEC (FINLAND) OY, Espoo (FI)

(72) Inventors: Mari Lindgren, Pori (FI); Henri K. Virtanen, Pori (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/104,312

(22) PCT Filed: Dec. 16, 2014

(86) PCT No.: PCT/FI2014/051005

§ 371 (c)(1),
(2) Date: Jun. 14, 2016

(87) PCT Pub. No.: WO2015/092133

PCT Pub. Date: Jun. 25, 2015

(65) Prior Publication Data

US 2016/0312376 A1 Oct. 27, 2016

(30) Foreign Application Priority Data

Dec. 18, 2013 (FI) ..... 20136286

(51) Int. Cl.

| | |
|---|---|
| ***C25F 3/06*** | (2006.01) |
| ***C25C 7/02*** | (2006.01) |
| ***C25C 7/06*** | (2006.01) |

(52) U.S. Cl.
CPC ..... *C25F 3/06* (2013.01); *C25C 7/02* (2013.01); *C25C 7/06* (2013.01)

(58) Field of Classification Search
CPC ..... C25F 3/06; C25C 7/02; C25C 7/06
See application file for complete search history.

(56) References Cited

U.S. PATENT DOCUMENTS

| | | | | |
|---|---|---|---|---|
| 3,741,747 | A | 6/1973 | Hamilton et al. | |
| 4,139,430 | A * | 2/1979 | Parkinson | C25C 1/00 205/575 |

(Continued)

FOREIGN PATENT DOCUMENTS

| | | | |
|---|---|---|---|
| CN | 1780939 | A | 5/2006 |
| CN | 101166850 | A | 4/2008 |

(Continued)

OTHER PUBLICATIONS

International Search Report issued by the European Patent Office acting as the International Search Authority for International Application No. PCT/FI2014/051005 dated Apr. 10, 2015 (3 pages).

(Continued)

*Primary Examiner* — Nicholas A Smith
(74) *Attorney, Agent, or Firm* — Robert P. Michal, Esq.; Carter, DeLuca, Farrell & Schmidt, LLP

(57) ABSTRACT

A method for maintenance of used permanent cathode plates, said used cathode plate having scratches, crud formations and oversize grain boundaries on a surface of the cathode plate. The method comprises removing of scratches and accumulated crud from the surface of the cathode plate. The method further comprises removing substantially completely the oversize grain boundaries from the surface, and thereafter regenerating the grain boundaries of the surface of the cathode plate to an average grain boundary width of 1 to 3 μm and an average grain boundary depth less than 1 μm.

16 Claims, 7 Drawing Sheets

(56) References Cited

U.S. PATENT DOCUMENTS

| | | | | |
|---|---|---|---|---|
| 2006/0201586 | A1* | 9/2006 | Webb | C25C 7/02 148/325 |
| 2010/0078319 | A1* | 4/2010 | Palmu | C25C 7/02 204/293 |
| 2010/0189997 | A1* | 7/2010 | Kinouchi | C21D 1/46 428/334 |
| 2010/0219080 | A1* | 9/2010 | Webb | C25C 7/02 205/219 |
| 2012/0164472 | A1* | 6/2012 | Kuhn | C21D 1/18 428/621 |
| 2014/0131221 | A1* | 5/2014 | Lindgren | C25C 7/08 205/640 |

FOREIGN PATENT DOCUMENTS

| | | | |
|---|---|---|---|
| CN | 101501914 | A | 8/2009 |
| CN | 101611175 | A | 12/2009 |
| CN | 102625863 | A | 8/2012 |
| EP | 1336670 | A2 | 8/2003 |
| EP | 1531014 | A2 | 5/2005 |
| JP | 255884/1993 | | 10/1993 |
| JP | 2008533296 | A | 8/2008 |
| WO | WO-2010/102327 | A1 | 9/2010 |
| WO | WO-2012/175803 | A2 | 12/2012 |

OTHER PUBLICATIONS

Written Opinion of the International Searching Authority issued by the European Patent Office acting as the International Search Authority for International Application No. PCT/FI2014/051005 (6 pages).

Notification of Transmittal of the International Preliminary Report on Patentability issued by the European Patent Office acting as the International Preliminary Examining Authority for International Application No. PCT/FI2014/051005 dated Jan. 8, 2016 (14 pages).

Chinese Office Action entitled Notification of First Office Action issued by the State Intellectual Property Office of the People's Republic of China in relation to Chinese Applicaiton No. 201480072269.9 dated Apr. 24, 2017 (5 pages) along with English language translation (6 pages).

Japanese Office Action entitled Notification of Reason for Refusal issued by the Japanese Patent Office in relation to Japanese Patent Application No. 2016-540496 dated Apr. 18, 2017 (3 pages) along with English language translation 3 pages).

* cited by examiner

METHOD FOR MAINTENANCE OF USED PERMANENT CATHODE PLATES

CROSS-REFERENCE TO RELATED APPLICATIONS

This application is a National Phase Entry under 35 USC §371 of PCT Patent Application Serial No. PCT/FI2014/051005 filed Dec. 16, 2014, which claims the benefit under 35 USC §119(e) to Finnish Patent Application No. 20136286, filed Dec. 18, 2013, the disclosure of each of these applications are expressly incorporated herein by reference in their entireties.

FIELD OF THE INVENTION

The present invention relates to a method for maintenance of used permanent cathode plates.

BACKGROUND OF THE INVENTION

When the intention is to manufacture pure metal such as copper, hydrometallurgical methods such as electrolytic refining or recovery are used. The electrowinning and electrorefining processes are current methods to recover the metals, such as copper, zinc, cobalt or nickel. In electrolytic refining, impure metal anodes are dissolved electrochemically, and the metal dissolved from them is reduced onto the cathode. In electrolytic recovery, the metal is reduced directly from the electrolytic solution. The cathodes used in the process can be starter sheets made of the metal to be reduced, or permanent cathodes made of stainless steel, for example. A transition to the use of permanent cathodes has been the prevailing trend at electrolytic plants for a long time, and in practice, e.g. all new copper electrolysis processes are based on this technology.

A permanent cathode is formed of a cathode plate and an attached suspension bar using which the cathode is suspended in the electrolytic bath. The deposited metal can be mechanically stripped from the surfaces of permanent cathode plate, and the permanent cathodes can be reused. Permanent cathodes can be used in both electrolytic refining and recovery of metals. The corrosion resistance of the steel grade used as a permanent cathode plate in the electrolyte is not enough to guarantee that the properties required of the cathode are fulfilled. Substantial attention must be paid to the adhesion properties of the cathode plate surface. The surface properties of a permanent cathode plate must be appropriate so that the depositing metal does not spontaneously strip off from the surface during the electrolytic process but adheres sufficiently, however not preventing the deposited metal from being removed using a stripping machine, for example.

The most important properties required of a permanent cathode plate include corrosion resistance, straightness and surface properties with regard to the adhesion and removability (strippability) of the deposited metal.

During years in operation the permanent cathode plates deteriorate by the chemical (corrosion) and mechanical (bending and hammering during stripping) effects to such a condition that the surface properties may not any more fulfill the requirements of sufficient adhesion and removability. In operation, cruds and mottles are formed on the surfaces of the permanent cathode plate and the surface quality deteriorates during lifetime due to scratches and dents generated in use and corrosion. Therefore the permanent cathode does not any more function optimally and adhesion problems may occur.

So far, the only solution to prolong the lifetime of the permanent cathodes has been the maintenance of the permanent cathode plates by subjecting them to periodical repair where the accumulated crud and scratches are removed from the surfaces by grinding and the edge insulation is replaced. The permanent cathode plate may also be straightened if required. The problem with the current method is that, in practice, it has proved that such a treatment solves the problem only momentarily.

It is known, that in addition to the macro roughness of the surface, which is a commonly measured characteristics and which is changed in grinding, also the characteristics of the grain boundaries have a significant role for the adhesion and strippability of the deposited metal because the grain boundaries in micro scale serve as adhesion points for the depositing metal. The depth and width of the grain boundaries must be in a certain relation to each other so that the depositing metal adheres sufficiently but not too tightly to the surface of the permanent cathode plate. A prior art document WO 2012/175803 A2 discloses preferable grain boundary dimensions for permanent cathode plates.

In operation, impurities and cruds are precipitated on the grain boundaries and on the grain interiors and also the corrosion changes the micro structure so that the grain boundaries become oversize, i.e. overly deep and/or wide, whereby optimal surface characteristics are lost.

Examples of the deteriorated surfaces of the permanent cathode plates are shown in FIGS. 1 to 4. FIG. 1 shows how a used and deteriorated permanent cathode plate looks like visually seen by eye. The plate is severely mottled. FIG. 2 shows a microscopic view of the used and deteriorated permanent cathode plate showing the copper arsenide crud covering the surface. Grain boundaries under the crud are barely visible. FIG. 3 shows a microscopic view of the used and deteriorated permanent cathode plate showing black and white crud on the surface. Grain boundaries under the crud are barely visible. FIG. 4 shows a microscopic view of the used permanent cathode plate surface after the crud has been removed. Pitting corrosion on the grain boundaries can be seen making the grain boundaries overly wide and deep and non-optimal with respect to adhesion and strippability.

The currently available maintenance by grinding affects only the macro roughness of the surface of the permanent cathode plate, said macro roughness having only a secondary role to the functionality of the permanent cathode plate. Further, the microscopic sharp formations on surface caused by grinding are disadvantageous from the point of view of crud accumulation, corrosion resistance and current distribution which may explain the rapid degradation of the quality of the merely ground surface in use. Therefore, prolonging of the lifetime of the permanent cathodes only by the currently available method does not provide a durable and long-lasting result.

OBJECTIVE OF THE INVENTION

The objective of the invention is to alleviate the disadvantages mentioned above.

In particular, it is an objective of the present invention to provide a method which produces an optimal surface quality for the used permanent cathode plate which corresponds to the surface quality of an unused permanent cathode plate with appropriate adhesion and strippability characteristics thus providing a significant prolonging of the lifetime of the permanent cathode plate.

SUMMARY OF THE INVENTION

According to an aspect, the present invention provides a method for maintenance of used permanent cathode plates, said used cathode plate having scratches, crud formations and oversize grain boundaries on a surface of the cathode plate, the method comprising a step of removing of scratches and accumulated crud from the surface of the cathode plate. According to the invention the method comprises removing substantially completely the oversize grain boundaries from the surface, and thereafter regenerating the grain boundaries of the surface of the cathode plate to an average grain boundary width of 1 to 3 μm and an average grain boundary depth less than 1 μm.

The advantage of the invention is that old used permanent cathode plates which otherwise would be at the end of their lifetime can be repaired to substantially correspond to the new ones in order to prolong their lifetime. For example, an electrolysis plant typically has about 30 000 permanent cathode plates. If all these are at the same time coming to the end of their lifetime, it is a large investment to renew all these. With the aid of the method of the present invention it is possible to allocate renewal investment costs of the permanent cathode plates to several years.

The method is suitable for maintaining permanent cathode plates made of stainless steel, such as ferritic, austenitic or duplex stainless steel.

In an embodiment of the invention, the method comprises alkaline treatment of the surface of the cathode plate for removing the accumulated crud before removing the oversize grain boundaries from the surface of the cathode plate.

In an embodiment of the invention, the method comprises mechanical grinding of the surface of the cathode plate for removing the accumulated crud.

In an embodiment of the invention, method comprises mechanical grinding of the surface of the cathode plate for removing the oversize grain boundaries.

In an embodiment of the invention, the mechanical grinding is performed in two phases comprising a first phase grinding to surface roughness Ra of about 0.9-1.1 μm and thereafter a second phase grinding to surface roughness Ra of about 0.2-0.4 μm.

In an embodiment of the invention, the mechanical grinding is implemented by belt grinding and/or by circular grinding.

In an embodiment of the invention, the alkaline treatment of the surface comprises subjecting the surface to liquid caustic soda (NaOH) having pH>10 or to potassium hydroxide (KOH).

In an embodiment of the invention, the alkaline treatment of the surface comprises subjecting the surface to 10M liquid caustic soda (NaOH) in temperature 50° C.

In an embodiment of the invention, regenerating of the grain boundaries of the surface of the cathode plate is made chemically or electrochemically.

In an embodiment of the invention, the electrochemical regenerating of the grain boundaries comprises etching the plate surface with nitric acid 60% solution ($HNO_3$) using current 15-40 As/cm$^2$, preferably 20 As/cm$^2$.

In an embodiment of the invention, the chemical regenerating of the grain boundaries comprises subjecting the plate surface to oxalic acid ($H_2C_2O_4$) or to sulphuric acid ($H_2SO_4$) or to sulphuric acid-based copper electrolyte.

In an embodiment of the invention, the electrochemical regenerating of the grain boundaries comprises subjecting the plate surface to sulphuric acid-based electrolyte obtained from electrolysis. The sulphuric acid-based electrolyte is advantageous because it is readily available in electrolysis plants.

In an embodiment of the invention, the electrochemical regenerating of the grain boundaries comprises etching the plate surface with sulphuric acid-based electrolyte using current 10-40 As/cm$^2$, preferably 20 As/cm$^2$.

In an embodiment of the invention, the method comprises passivation of the surface after regeneration of the grain boundaries.

In an embodiment of the invention, the passivation of the surface comprises dipping the cathode plate into nitric acid ($HNO_3$) or citric acid ($C_6H_8O_7$).

In an embodiment of the invention, the method comprises neutralizing and washing of the surface to neutralize and wash out the nitric acid or citric acid after passivation.

It is to be understood that the aspects and embodiments of the invention described above may be used in any combination with each other. Several of the aspects and embodiments may be combined together to form a further embodiment of the invention.

DETAILED DESCRIPTION OF THE INVENTION

Figure 1:
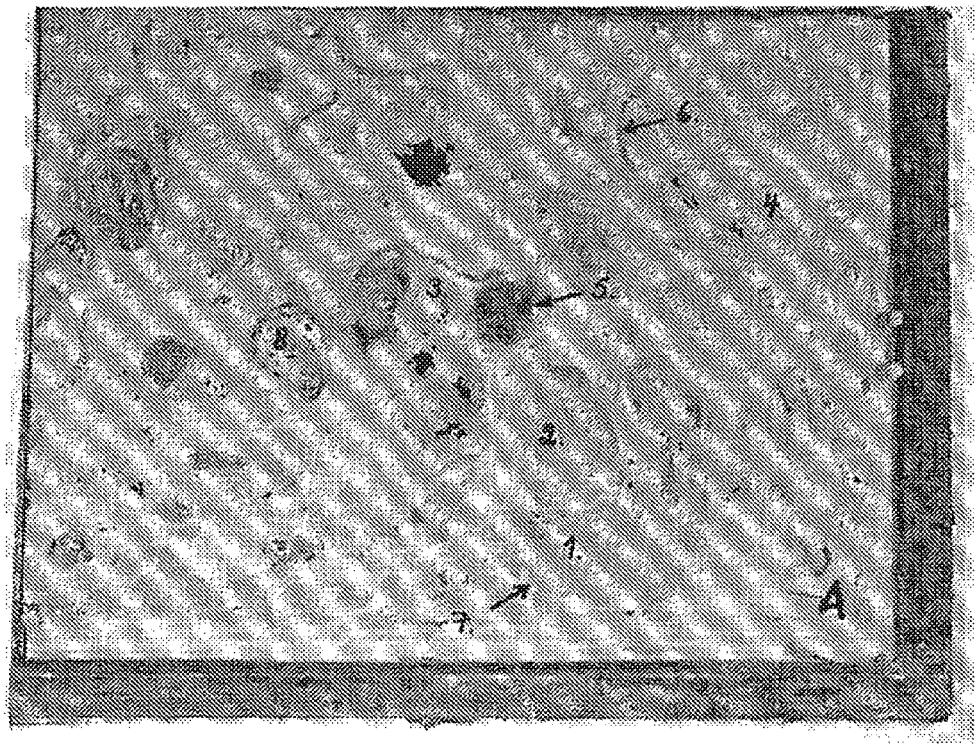
FIG. 1 is a photographic image of a used and deteriorated permanent cathode plate.
Figure 2:
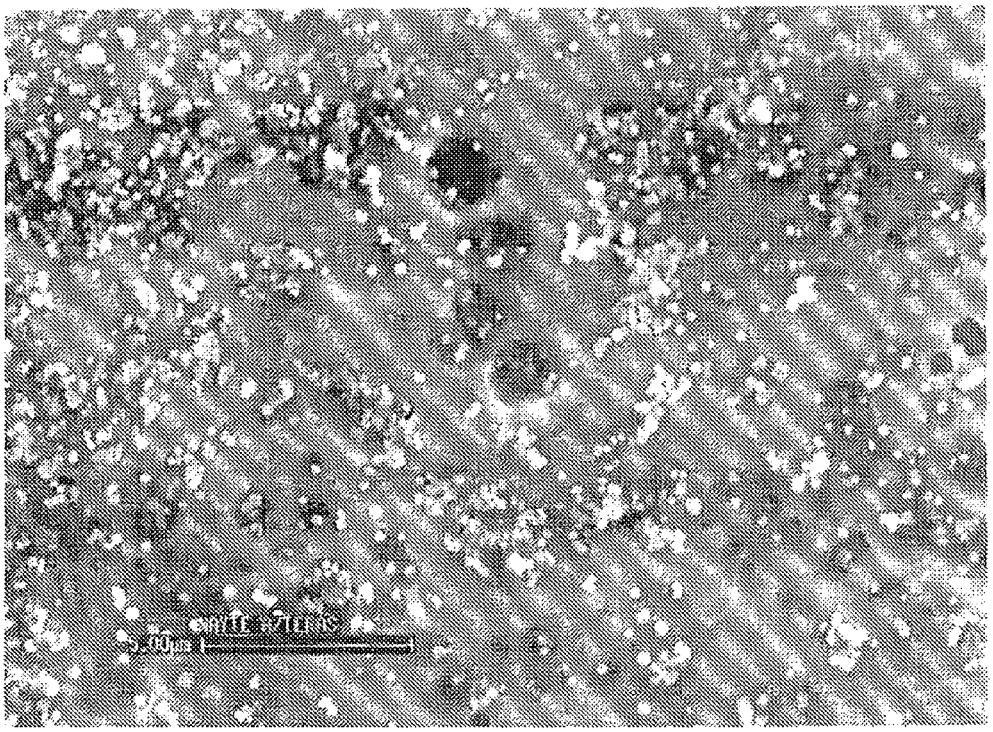
FIG. 2 is a microscopic image showing a microscopic view of the surface of the used and deteriorated permanent cathode plate with copper arsenide crud on the surface.
Figure 3:
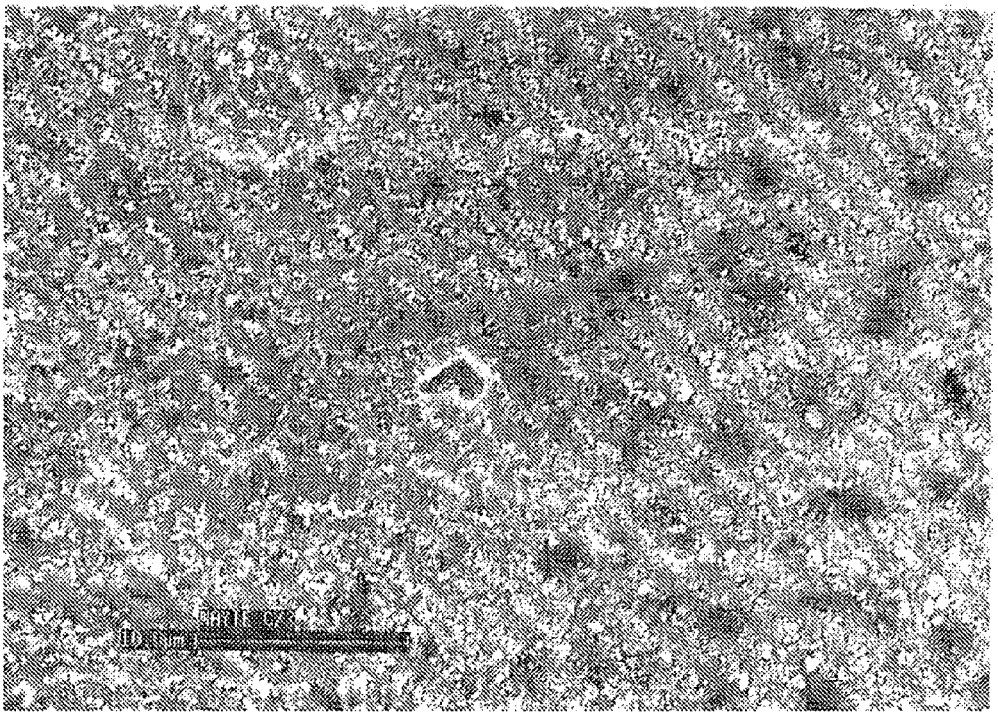
FIG. 3 is a microscopic image showing a microscopic view of the surface of the used and deteriorated permanent cathode plate with black and white crud on the surface.
Figure 4:
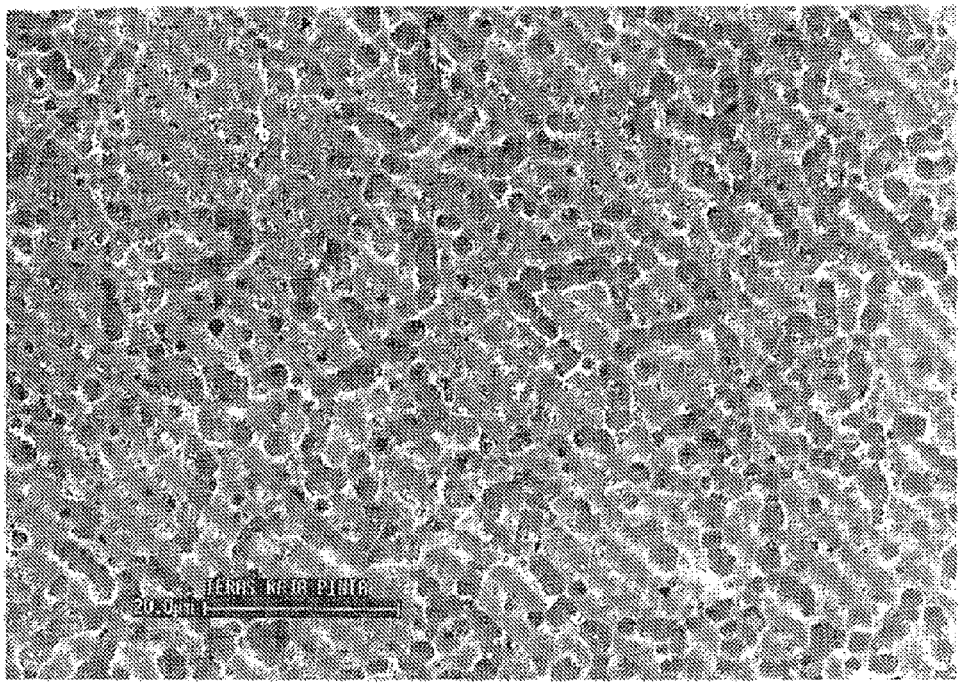
FIG. 4 is a microscopic image showing a microscopic view of the surface of the used and deteriorated permanent cathode plate with pitting corrosion on grain boundaries.

A used permanent cathode plate has scratches, crud formations and oversize grain boundaries on the surface of the cathode plate. Therefore, in the method for maintenance of used permanent cathode plates, scratches and accumulated crud are first removed from the surface of the cathode plate. Removing of the crud may be made by alkaline treatment of the surface of the permanent cathode plate. In the alkaline treatment the surface of the permanent cathode plate may be subjected to 10M liquid caustic soda (NaOH) having pH>10 in temperature 50° C. Alternatively, the alkaline treatment may be made by subjecting the surface of the permanent cathode plate to potassium hydroxide (KOH). Alkaline treatment is not necessary if the surface of the permanent cathode plate is subjected to mechanical grinding which may be used for removing the scratches, crud formations and also the grain boundaries from the surface. It is essential to remove substantially completely the oversize grain boundaries from the surface. The mechanical grinding is preferably performed in two phases comprising a first phase grinding to surface roughness Ra of about 0.9-1.1 μm and thereafter a second phase grinding to surface roughness Ra of about 0.2-0.4 μm. The mechanical grinding may be made by belt grinding or circular grinding or any other suitable grinding method.

After the removal of the grain boundaries, the grain boundaries of the surface of the cathode plate are regenerated to their optimal dimensions, an average grain boundary width being 1 to 3 μm and an average grain boundary depth being less than 1 μm. The regenerating of the grain boundaries can be made electrochemically or chemically. The electrochemical regenerating of the grain boundaries of 316L stainless steel comprises subjecting the plate surface to nitric acid 60% solution ($HNO_3$) using current 15-40 As/cm$^2$, preferably 20 As/cm$^2$.

Alternatively, the chemical regenerating of the grain boundaries comprises subjecting the plate surface to oxalic acid ($H_2C_2O_4$) or to sulphuric acid ($H_2SO_4$) or to sulphuric acid-based electrolyte.

When regenerating of the grain boundaries is made by etching the plate surface with sulphuric acid-based electrolyte, current 10-40 As/cm$^2$, preferably 20 As/cm$^2$, is used. The sulphuric acid-based electrolyte is advantageous because it is readily available in electrolysis plants. Typically the acid content of electrolyte is 140-200 g/l and copper content 30-60 g/l.

After the regenerating of the grain boundaries, the surface may further be passivated. The passivation of the surface may include dipping the cathode plate into nitric acid ($HNO_3$) or to citric acid ($C_6H_8O_7$). After passivation it may be appropriate to neutralize and wash the surface to neutralize and wash out the acid.

The used permanent cathode plate subjected to the maintenance method of the invention is substantially as good as a new one and thus its lifetime may be prolonged for another 10 to 15 years.

EXAMPLES

Example 1

Figure 5:
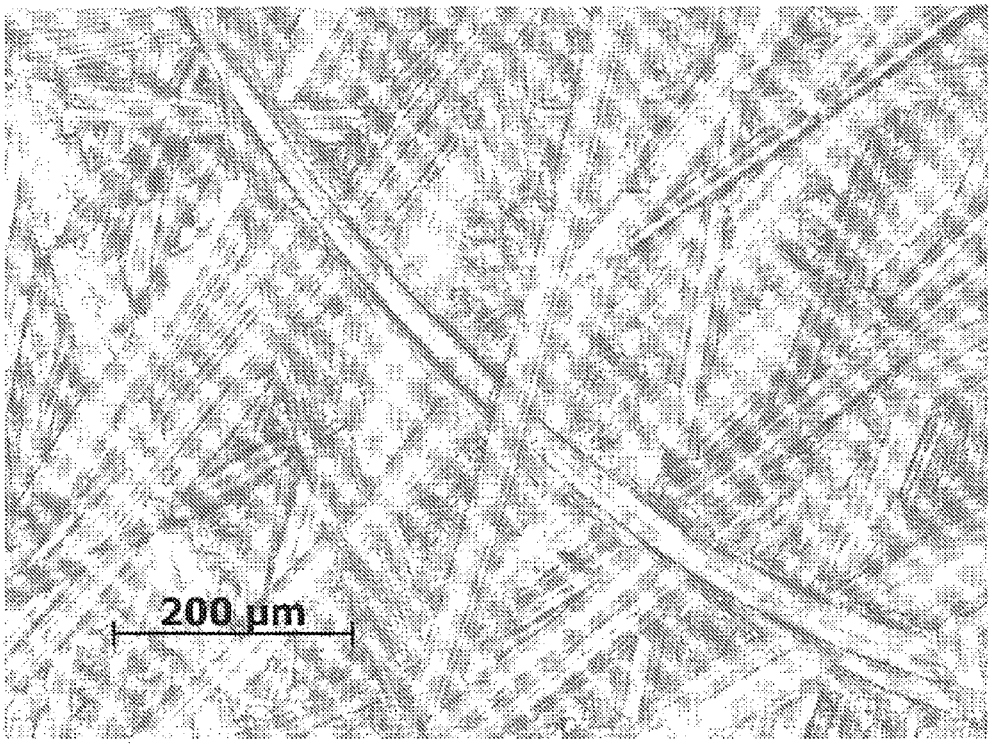
FIG. 5 is a microscopic image showing a microscopic view of the used permanent cathode surface after mechanical grinding.

A used permanent cathode surface was first cleaned with mechanical grinding to remove the accumulated crud. FIG. 5 shows an optical microscope image of the ground surface. When this ground surface was tested in a small scale copper refining and stripping test the stripping force needed for the deposited copper was only 0.5 N/mm$^2$. This value is too low compared to the typical value of 1.0 N/mm$^2$ for a new permanent cathode surface. Then the surface was electrolytically etched in 60% nitric acid using a current density of 18 mA/cm$^2$ and a total current of 20 As/cm$^2$ to modify the grain boundaries. After etching an electrorefining and stripping test similar made to the bare ground surface was made. Measured stripping force copper deposit was now 1.1 N/mm$^2$ which is close enough to the value measured for copper deposit from a new permanent cathode surface.

Example 2

Figure 6:
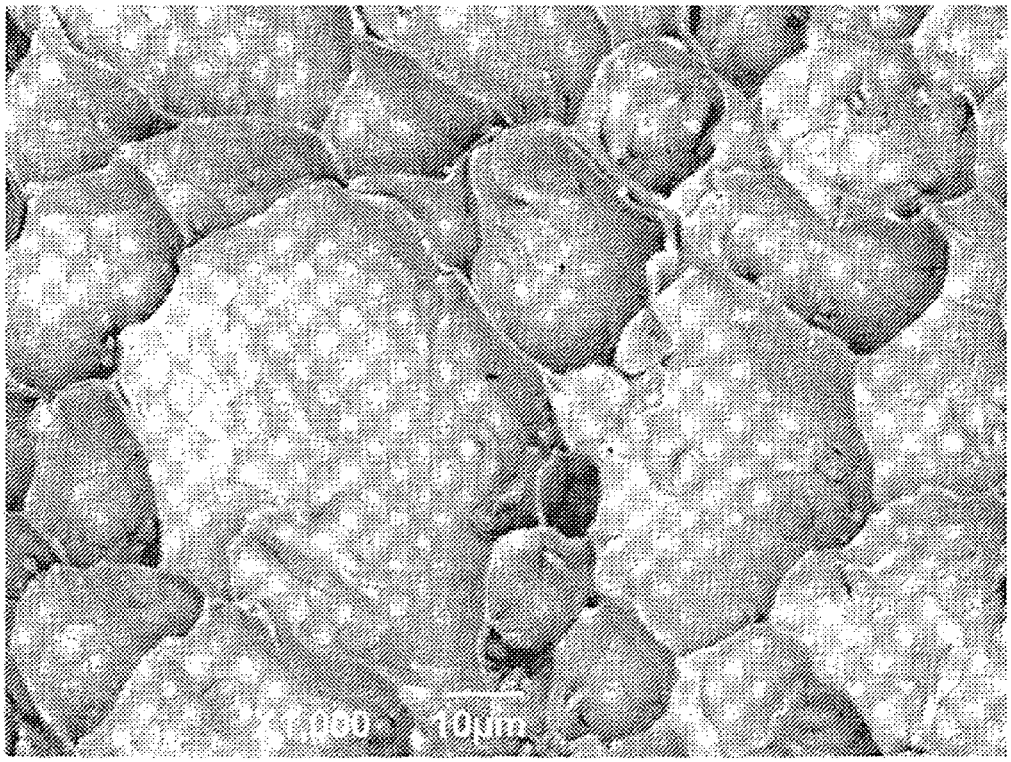
FIG. 6 is a microscopic image showing a microscopic view of a copper replica of the treated permanent cathode surface in which the too long time in electrolytic etching has created too deep grain boundaries.

A used 316L permanent cathode surface was ground and electrically etched in 60% nitric acid using a current density of 18 mA/cm$^2$ and a total current of 41 As/cm$^2$. After etching a small scale copper electrorefining and stripping test was made. The measured stripping force for copper deposit was higher than 3.0 N/mm$^2$ which is far too high. The surface of the copper deposit close to the etched permanent cathode surface was viewed with a microscope to see what has happened to the grain boundaries during etching. It can be seen that the depth of the grain boundaries has increased too much and this was the reason for the too high stripping force obtained. FIG. 6 shows a copper replica of the surface whose grain boundaries were etched too deep.

Example 3

Figure 7:
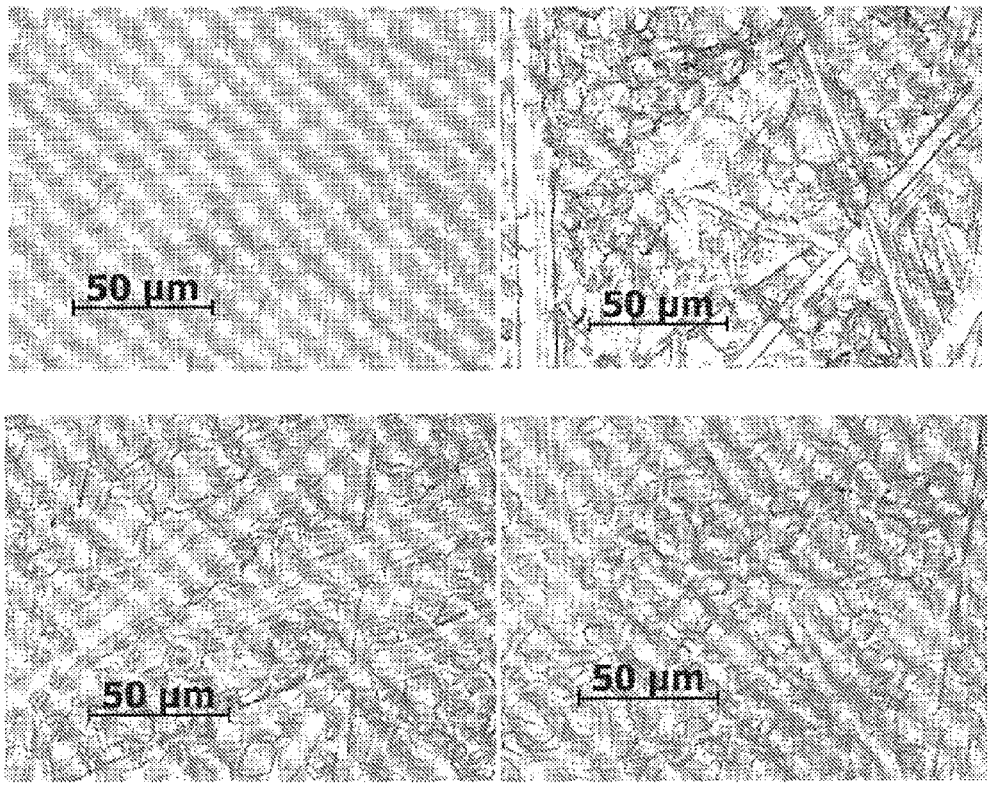
FIG. 7 is a microscopic image showing the modification of the grain boundaries with time when electrolytically etching in copper electrolyte.

As nitric acid is not commonly used in copper refineries and it has relatively small time window to produce an optimal cathode surface, electrolytic etching was performed in 150 g/l sulphuric acid with 50 g/l copper which corresponds to the electrolyte that is typically used in copper electrolysis. Etching with currents of 10-60 As/cm$^2$ influenced the width and depth of the grain boundaries as a function of time as demonstrated in FIG. 7. The current density and treatment time are specific to a certain stainless steel grade but can be selected based on the dimensions of the grain boundaries.

When using copper electrolyte in the electrolytical etching stainless steel plates can be used as cathodes. Copper will be deposited on them but if needed it can be dissolved or mechanically stripped off.

The invention claimed is:

1. A method for maintenance of used permanent cathode plates made of stainless steel, said used cathode plate having scratches, crud formations and oversize grain boundaries on a surface of the cathode plate, the method comprising:

removing of scratches and accumulated crud from the surface of the cathode plate, removing substantially completely the oversize grain boundaries from the surface, and thereafter regenerating the grain boundaries of the surface of the cathode plate to an average grain boundary width of 1 to 3 μm and an average grain boundary depth less than 1 μm.

2. The method according to claim 1, further comprising alkaline treatment of the surface of the cathode plate for removing the accumulated crud before removing the oversize grain boundaries from the surface of the cathode plate.

3. The method according to claim 1, further comprising mechanical grinding of the surface of the cathode plate for removing the accumulated crud.

4. The method according to claim 1, further comprising mechanical grinding of the surface of the cathode plate for removing the oversize grain boundaries.

5. The method according to claim 1, further comprising mechanical grinding of the surface of the cathode plate wherein the mechanical grinding is performed in two phases comprising a first phase grinding to surface roughness Ra of about 0.9-1.1 μm and thereafter a second phase grinding to surface roughness Ra of about 0.2-0.4 μm.

6. The method according to claim 5, wherein the mechanical grinding is implemented by at least one of belt grinding and circular grinding.

7. The method according to claim 2, wherein, the alkaline treatment of the surface comprises subjecting the surface to liquid caustic soda (NaOH) having a pH greater than at least one of 10 and a pH of potassium hydroxide (KOH).

8. The method according to claim 7, wherein the alkaline treatment of the surface comprises subjecting the surface to 10M liquid caustic soda (NaOH) at a temperature of 50° C.

9. The method according to claim 1, wherein regenerating of the grain boundaries of the surface of the cathode plate is performed by at least one of the chemically and electrochemically.

10. The method according to claim 1, wherein the electrochemical regenerating of the grain boundaries comprises etching the plate surface with nitric acid 60% solution ($HNO_3$) using a current of 15-40 As/cm$^2$, and preferably 20 As/cm$^2$.

11. The method according to claim 1, wherein the chemical regenerating of the grain boundaries comprises subjecting the plate surface to at least one of oxalic acid ($H_2C_2O_4$) and sulphuric acid ($H_2SO_4$) and sulphuric acid-based copper electrolyte.

12. The method according to claim 1, wherein the electrochemical regenerating of the grain boundaries comprises subjecting the plate surface to sulphuric acid-based electrolyte obtained from electrolysis.

13. The method according to claim 1, wherein the electrochemical regenerating of the grain boundaries comprises etching the plate surface with sulphuric acid-based electrolyte using current 10-40 As/cm$^2$, preferably 20 As/cm$^2$.

14. The method according to claim 1, further comprising passivation of the surface after regeneration of the grain boundaries.

15. The method according to claim 14, wherein the passivation of the surface comprises dipping the cathode plate into nitric acid ($HNO_3$) or citric acid ($C_6H_8O_7$).

16. The method according to claim 15, further comprising neutralizing and washing of the surface to neutralize and wash out the nitric acid or citric acid after passivation.

* * * * *